US006253951B1

(12) United States Patent
Pruckler

(10) Patent No.: US 6,253,951 B1
(45) **Date of Patent: *Jul. 3, 2001**

(54) APPARATUS AND SYSTEM FOR COVERING AND PROTECTING THE RIM OF A PAINT CAN

(76) Inventor: Robert M. Pruckler, 4580 Squires Cir., Boulder, CO (US) 80303

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/056,371

(22) Filed: Apr. 7, 1998

(51) Int. Cl.[7] ..... B65D 25/00

(52) U.S. Cl. ..... 220/733; 220/359.1; 220/359.2; 220/359.3; 220/699; 220/700; 220/701

(58) Field of Search ..... 220/695, 698–701, 220/733, 359.1, 359.2, 704, 718, 783, 787, 798, 801, 359.3, DIG. 21, 716, 702, 287; 206/813; 215/232, 400, 319; 283/79, 80; 4/245.5, 245.4; 128/894, 893; 150/154

(56) References Cited

U.S. PATENT DOCUMENTS

| | | | | |
|---|---|---|---|---|
| D. 29,466 | * | 10/1898 | Green | 220/704 X |
| 591,778 | * | 10/1897 | Donahue et al. | 220/718 |
| 939,698 | * | 11/1909 | Jancey | 220/716 |
| 1,283,533 | * | 11/1918 | Leighton | 4/245.4 X |
| 1,344,179 | * | 6/1920 | Lopez et al. | 220/716 |
| 1,635,072 | * | 7/1927 | De Luna | 220/DIG. 21 X |
| 2,116,418 | * | 5/1938 | Smithson | 220/718 |
| 2,240,647 | * | 5/1941 | Hartman et al. | 220/718 |
| 2,268,241 | * | 12/1941 | Brueckel | 220/771 X |
| 2,459,558 | * | 1/1949 | Villegs De Oribe | 220/716 |
| 2,611,508 | * | 9/1952 | Brown | 220/733 |
| 2,614,406 | * | 10/1952 | Carpenter | 220/718 |
| 2,668,635 | * | 2/1954 | Bennett | 220/733 |
| 2,753,049 | * | 7/1956 | Gaines et al. | 220/718 X |
| 2,849,158 | * | 8/1958 | Hopla | 220/698 X |
| 2,945,611 | * | 7/1960 | Weiffenbach . | |
| 2,945,612 | * | 7/1960 | Weinffenbach . | |
| 3,063,555 | * | 11/1962 | Hanington | 128/894 X |
| 3,301,254 | * | 1/1967 | Schickedanz | 128/894 |
| 3,391,847 | * | 7/1968 | Christine et al. | 220/359.3 X |
| 3,603,485 | | 9/1971 | Fickle et al. . | |
| 3,712,519 | | 1/1973 | Collie . | |
| 3,776,415 | * | 12/1973 | Pfeffer | 220/701 |

(List continued on next page.)

FOREIGN PATENT DOCUMENTS

| | | | | |
|---|---|---|---|---|
| 18763 | * | 1/1905 | (AT) | 220/716 |
| 1026253 | * | 7/1903 | (FR) | 220/716 |
| 15160 | * | 7/1903 | (GB) | 220/716 |
| 2674 | * | 1/1908 | (GB) | 220/716 |
| 2188828 | * | 8/1936 | (GB) | 220/718 |
| 252844 | * | 4/1927 | (IT) | 220/718 |
| 284752 | * | 1/1935 | (IT) | 220/716 |
| 335802 | * | 8/1936 | (IT) | 220/716 |

*Primary Examiner*—Allan N. Shoap
*Assistant Examiner*—Robin A. Hylton
(74) *Attorney, Agent, or Firm*—Stuart T. Langley; Hogan & Hartson, L.L.P.

(57) ABSTRACT

A paint can rim seal and groove protector that is simple and inexpensive in its manufacture and construction and easily allows the pouring of paint or other liquid from a can. A seal for a can rim includes a deformable rim seal having a width defined by an interior diameter smaller than the can rim and an exterior diameter larger than the can rim. A pressure sensitive releasable adhesive coating is provided on one surface of the deformable rim seal. In operation, the rim seal is aligned with the can rim with the adhesive coated side down. The rim seal is then removably placed on the rim. Interior and exterior edges of the rim seal are manually bent down to adhesively seal against the interior and exterior sidewalls of the can.

7 Claims, 5 Drawing Sheets

U.S. PATENT DOCUMENTS

| | | | | |
|---|---|---|---|---|
| 3,811,606 | | 5/1974 | Higgins . | |
| 3,894,650 | | 7/1975 | Crump . | |
| 3,913,785 | | 10/1975 | Pattershall . | |
| 3,938,686 | * | 2/1976 | Milligan et al. | 220/700 X |
| 3,980,213 | | 9/1976 | Ramsey . | |
| 4,009,802 | | 3/1977 | Hayduchok . | |
| 4,014,465 | | 3/1977 | Ritter . | |
| 4,125,210 | | 11/1978 | Embree . | |
| 4,203,537 | | 5/1980 | McAlister . | |
| 4,216,763 | * | 8/1980 | Miklas | 220/771 X |
| 4,225,064 | | 9/1980 | Westcott . | |
| 4,352,438 | * | 10/1982 | Carino | 220/718 X |
| 4,369,890 | | 1/1983 | Bennett . | |
| 4,452,842 | * | 6/1984 | Borges et al. | 220/359.3 X |
| 4,533,576 | * | 8/1985 | Tanahashi et al. | 428/35 |
| 4,550,842 | * | 11/1985 | Cummings | 220/359.3 X |
| 4,832,293 | | 5/1989 | Gizzi . | |
| 4,893,723 | | 1/1990 | Seabolt . | |
| 4,907,714 | | 3/1990 | Gatz . | |
| 4,911,319 | | 3/1990 | DeJean . | |
| 4,955,500 | * | 9/1990 | Rhoads | 220/212 |
| 4,969,570 | * | 11/1990 | Harvey, Sr. | 220/733 |
| 4,979,237 | * | 12/1990 | Hazar et al. | 4/245.4 X |
| 5,012,960 | | 5/1991 | Arnold . | |
| 5,072,847 | * | 12/1991 | Price . | |
| 5,372,268 | * | 12/1994 | Han | 220/359.3 X |
| 5,641,089 | | 6/1997 | Palank . | |
| 5,712,012 | * | 1/1998 | Forman et al. . | |
| 5,721,136 | * | 2/1998 | Finney et al. | 220/359.3 X |
| 5,779,244 | * | 7/1998 | Moriaty et al. | 277/311 |
| 5,984,135 | * | 11/1999 | Brown | 220/359.2 X |
| 6,015,059 | * | 1/2000 | Takayama | 220/359.2 X |

* cited by examiner

APPARATUS AND SYSTEM FOR COVERING AND PROTECTING THE RIM OF A PAINT CAN

BACKGROUND OF THE INVENTION

1. Field of the Invention

The present invention relates, in general, to seals for cans, and, more particularly, to a disposable seal for the rim of paint cans.

2. Relevant Background

Liquid coating materials such as paint, varnish, adhesives and the like are commonly distributed in resealable cans that hold substantially uniform quantity. This method of distribution is intended to enable the end user to use only a portion of the can's contents for a particular project, then reseal the cans to prevent evaporation of the water or solvent carrier. In practice, the ability to reuse the can's contents and the time period over which the contents remain usable is greatly dependent on the ability of the end user to effectively reseal the can.

End users may paint with a brush dipped directly in the can or pour the can contents into another container or apparatus such as a sprayer or rolling pan. Dipping a brush directly into the paint can and then wiping the brush against the side of the can or pouring paint from the can results in messy paint drippings. Importantly, such common use results in the groove portion at the top of the can becoming filled with paint. If the groove is filled with paint, the paint will splatter when the can lid is replaced causing even more paint to drip down the sides of the can and onto whatever surface supports the can. When dried in the groove, the paint diminishes the integrity of the groove, making it difficult to secure a tight seal with the lid. Loose seals cause the water or solvent carriers in the can to evaporate rendering the paint unsuitable for use. Moreover, when the lid is replaced with paint in the rim, the lid will stick to the wet paint, thereby making it difficult or impossible to re-open the can for the next use.

To improve the end-user's ability to seal the can it is desirable to protect the groove or rim in the top of the paint can so that the lid of the can will be securely replaced after use. Protecting the rim eliminates mess and preserves the contents of the can for long periods of time. There are a number of prior inventions that seek to provide protection of the can rim with covers that are expensive and complicated in use and manufacture. However, painting is an inherently simple task that is best practiced with tools and accessories that are simple to use and inexpensive. A need exists for a paint rim seal that is inexpensive yet easy to use while simplifying the end-user's tasks.

To enable a user to dip a paint brush directly into the can previous can rim seals have been manufactured with a slot to guide the brush. This arrangement requires a good aim and patience to dip the brush while the cover is engaged and fail to simplify the painter's task. Other designs enable the user to pour paint from the can with the cover in place by providing pouring spouts on the cover. These spouts are comparatively expensive to the end-user with the intent that the end-user will reuse the cover. Can rim protectors by design become covered with paint and reusable designs require cleaning before storage for reuse. What is needed is an easy to use paint can rim seal that minimizes clean-up time and effort.

SUMMARY OF THE INVENTION

The present invention is directed to a paint can rim seal and groove protector that is simple and inexpensive in its manufacture and use and easily allows the pouring of paint or other liquid from a can. Briefly stated, the present invention involves a seal for a can rim including a deformable rim seal having a width defined by an interior diameter smaller than the can rim and an exterior diameter larger than the can rim. A pressure sensitive releasable adhesive coating is provided on one surface of the rim seal. In operation, the rim seal is aligned with the can rim with the adhesive coated side down. Desirably, the seal has release paper covering to main adhesive integrity until ready for use. The rim seal is then removably placed on the rim. Interior and exterior edges of the rim seal may be manually bent down to adhesively seal to more securely anchor the rim seal onto the rim against the interior and exterior sidewalls of the can.

DETAILED DESCRIPTION OF THE PREFERRED EMBODIMENTS

Figure 1:
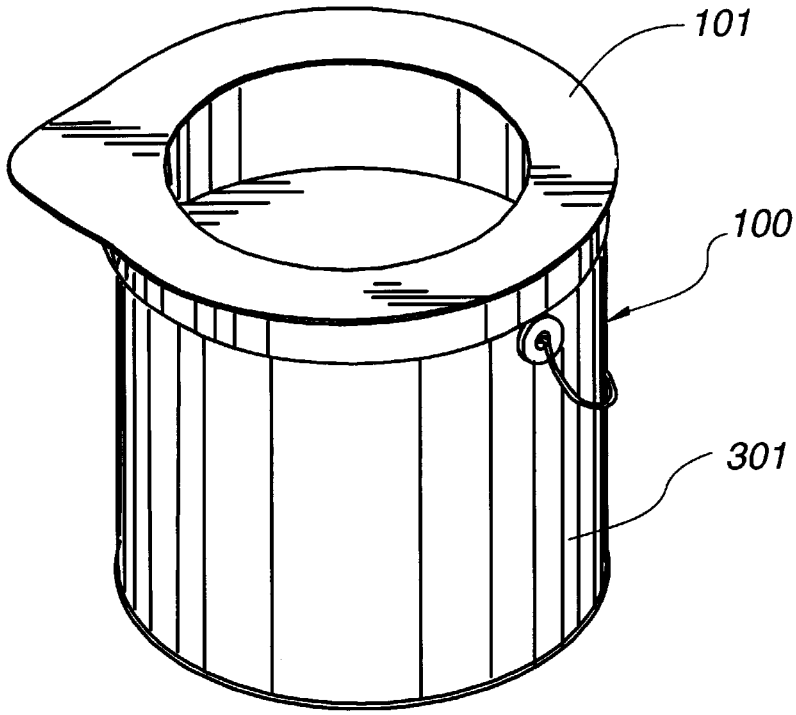
FIG. 1 shows a perspective view of an opened can during installation of a can rim seal in accordance with the present invention.

The present invention is described in terms of a paint can seal, but it is apparent that the basic teachings of the present invention are applicable to any liquid containing can having a rim that benefits by being protected from exposure to the liquid contained in the can. FIG. 1 shows a perspective view of an opened can 100 with a can rim seal 101 in accordance with the present invention partially installed on can 100. In the preferred examples, can 100 comprises a rigid material such as a metal but may also include other materials such as plastic, composites, resin impregnated paper, and the like. Can 100 may be single use or reusable.

Figure 2:
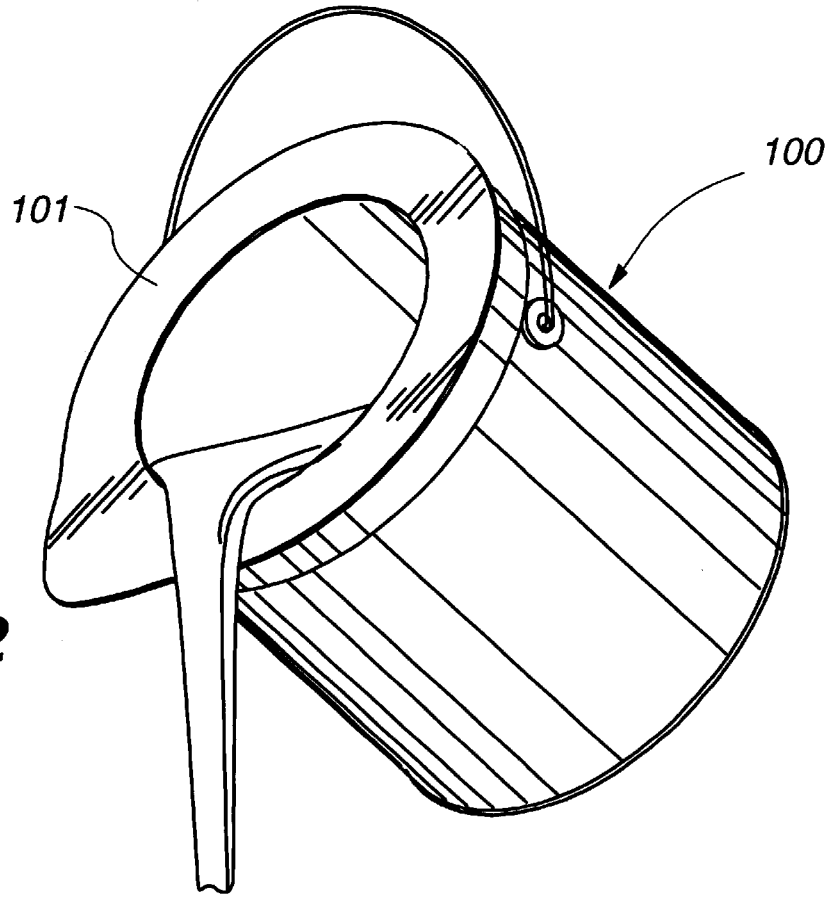
FIG. 2 illustrates the open can of FIG. 1 with a rim seal in accordance with the present invention installed and in use while pouring the can contents.

A top portion of can 100 has a rim that engages a complementary feature of a resealable can lid (not shown). In typical use the can lid is removed by prying or levering the engaging portion of the lid from a groove formed at the rim of can 100. Similarly, can 100 is resealed by engaging the can lid with the groove formed at the can rim. Paint can rim seal 101 in accordance the present invention is positioned over and adhesively sealed to the rim while the can lid is removed and the can is in use as shown in FIG. 2. The can rim seal 101 in accordance with the present invention is useful whether the can contents are distributed by brush, pouring, or using a paint spraying apparatus. Significantly during pouring and brush application, the interior edge of the can rim seal 101 desirably seals against an interior sidewall of can 100 to prevent seepage of can contents under can rim seal 101.

Figure 3:
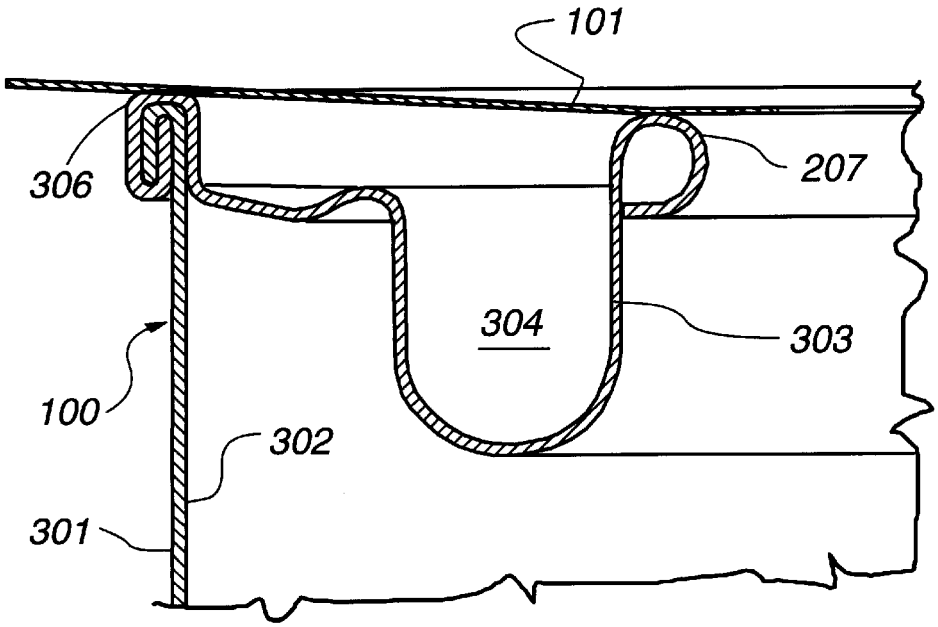
FIG. 3 illustrates a cross-section view of a portion of a paint can rim with a rim seal in accordance with the present invention partially applied.

FIG. 3 illustrates a cross-section view of a portion of a paint can rim with a rim seal in accordance with the present invention partially applied. Can 100 includes a wall having an exterior sidewall surface 301 and an interior sidewall surface 302. The upper portion of can 100 is terminated with a rim member 303 comprising an outer edge 306 sealed to the can wall, an inner edge 307, and a groove 304 defined between the inner and outer edges. Groove 304 is designed to mate with a complementary ridge in a can lid (not shown) as described above. Depending on the manufacturer, can rim 303 may vary significantly in width (i.e., span from interior edge 307 to exterior edge 306) and shape. This variation has made it difficult to develop a universal can rim seal that effectively protects groove 304.

Figure 4:
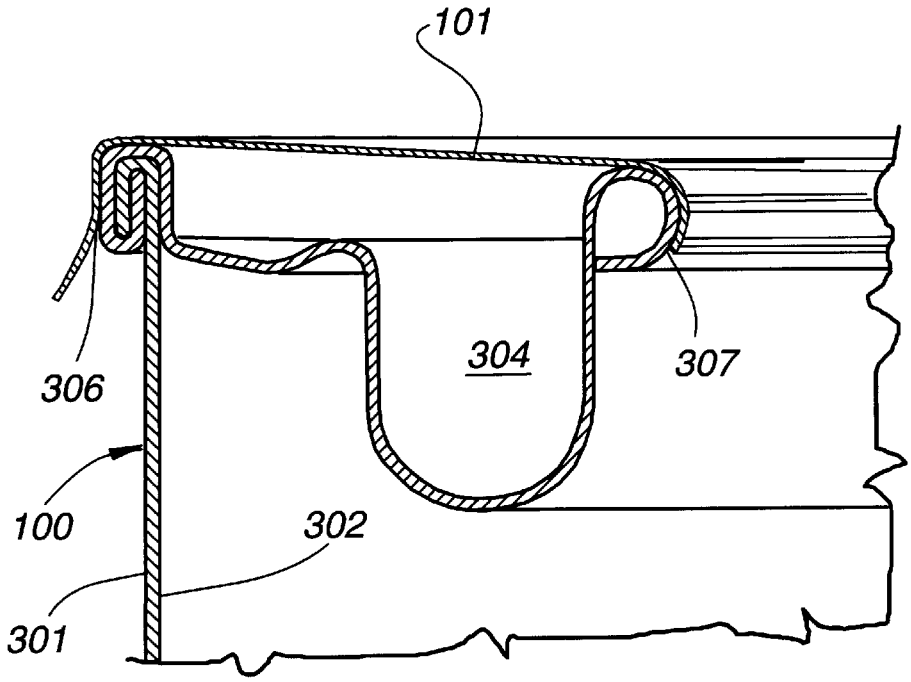
FIG. 4 shows the cross-section view of the can rim seal when fully installed.

As can rim seal 101 is applied, an adhesive coating (802 in FIG. 8) on a lower surface of seal 101 removably adheres to rim 303 especially at exterior edge 306 and interior edge 307. As shown in FIG. 4, edges of can rim seal 101 may be desirably folded about exterior edge 306 and interior edge 307.

Can rim seal 101 desirably comprises a material that is resistant to the contents of can 100 such as a water-resistant material (for water based paints) or solvent resistant material (for solvent-based paints). Can rim seal 101 need not be homogenous, and instead may comprise a surface coating that provides the desired resistance. In a particular example, a surface coating such as Teflon (a registered trademark of Dupont Corporation) or the like that beads the contents of can 100 is used.

The composition of can rim seal 101 is also chosen to complement the adhesive formed on the under side of seal 101 so that the combined sealing force provided by the adhesive and the memory of the material of rim seal 101 is sufficient to provide the desired adhesive seal to prevent seepage of the contents of can 100 underneath seal 101. In other words, a material with less memory is desirably coupled with a higher tack adhesive while a material with more memory provides adequate performance with a weaker, lower tack adhesive. The specific materials are chosen to meet the needs of a particular application.

Figure 5:
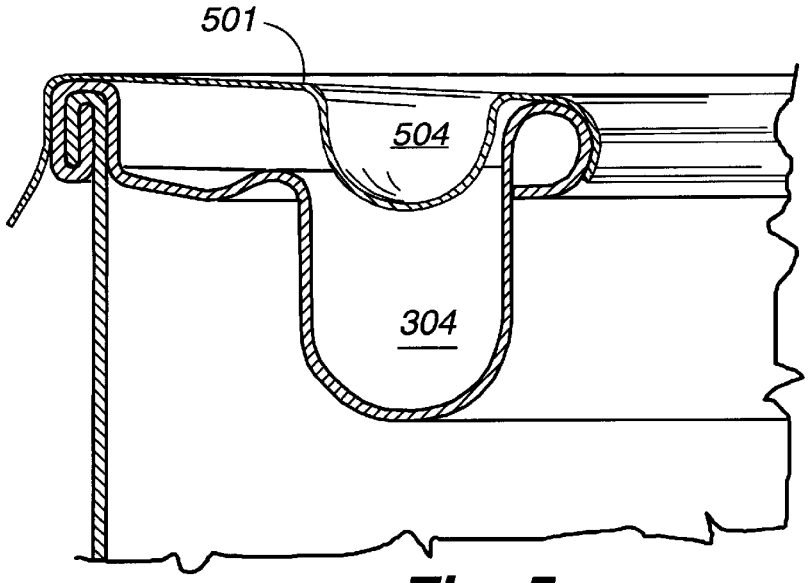
FIG. 5 illustrates a cross-section view of an alternative embodiment can rim seal in accordance with the present invention.

FIG. 5 illustrates a cross-section view of an alternative embodiment of can rim seal 501 in accordance with the present invention. In the embodiment of FIG. 5, can seal 501 includes an alignment ridge 504 that loosely aligns seal 501 with groove 304. This optional alignment feature eases use by guiding seal 501 into acceptable alignment with groove 304. The adhesive coating may be removed from the surface of alignment groove 504 to further aid alignment. Although the various embodiments in accordance with the present invention are shown without an alignment ridge 504, it should be understood that such a groove may be provided in any of the embodiments.

Figure 6:
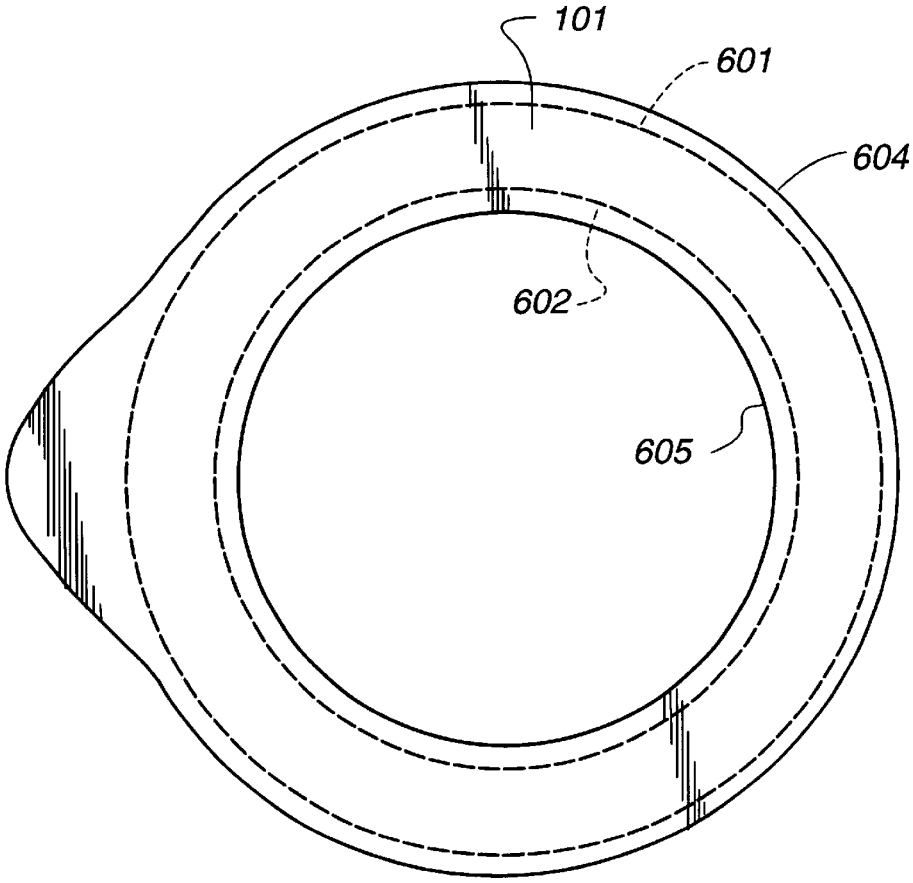
FIG. 6 shows a top plan view of a can rim seal in accordance with the present invention.

FIG. 6 shows a top plan view of a can rim seal 101 in accordance with the present invention. Significantly, seal 101 is sized to span at least between and preferably beyond an area defined by outer can circumference 601 and inner can circumference 602. In the preferred embodiments, seal 101 has an outer edge 604 that extends beyond outer can circumference 601 by a desired amount. Similarly, inner edge 605 extends beyond inner can circumference 602 by a desired amount. The desired amounts are selected to provide adequate extension down onto outer edge 306 and interior edge 307 as described hereinbefore.

Figure 7:
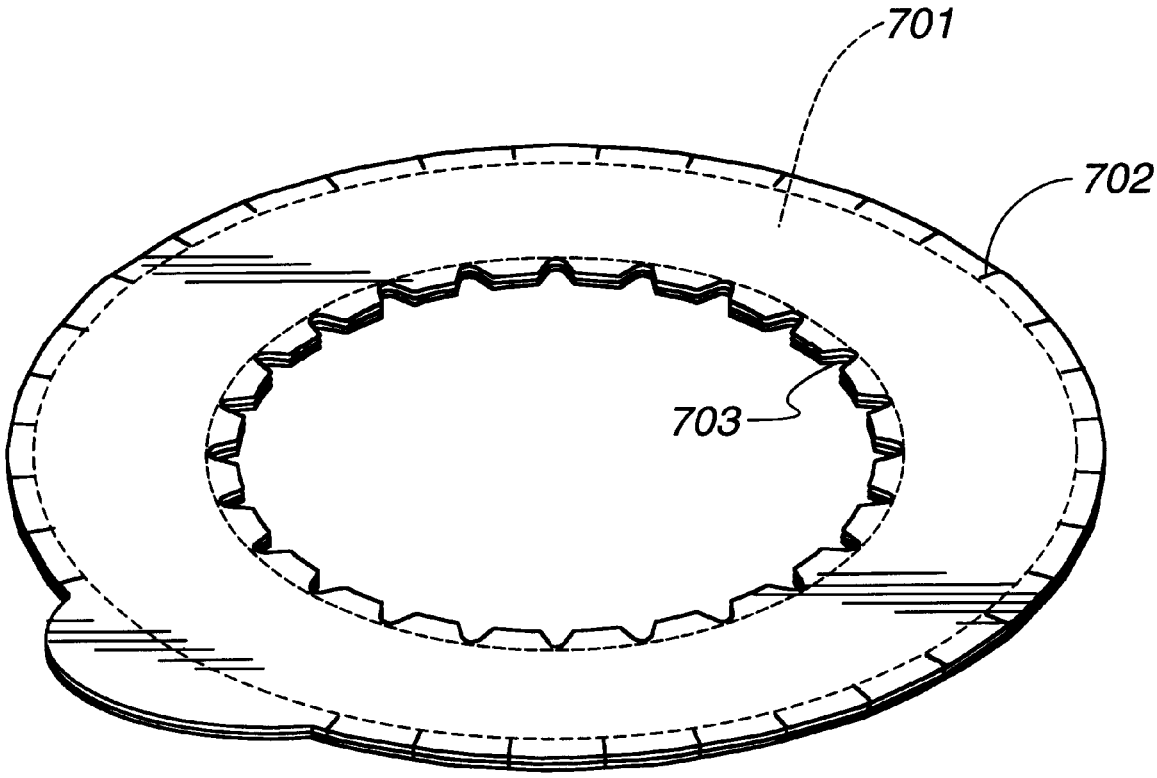
FIG. 7 shows a top plan view of an alternative embodiment can rim seal in accordance with the present invention.

FIG. 7 shows a top plan view of an alternative embodiment can rim seal 701 in accordance with the present invention. In this embodiment, rim seal 701 includes slitted edge 702 and/or notched edge 703 to ease folding of seal 701 about the sidewalls of can 100 without tearing. A plurality of rounded "V" shaped notches are formed on edge 703 in a particular implementation. It is contemplated that only one edge of either edges 702 and 703 may be scalloped and the other smooth as illustrated in previous embodiments. Other implementations are also contemplated in which scalloped edges 702 and 703 are rectangularly shaped or are defined by slits formed about the interior or exterior edge of seal 701.

Figure 8:
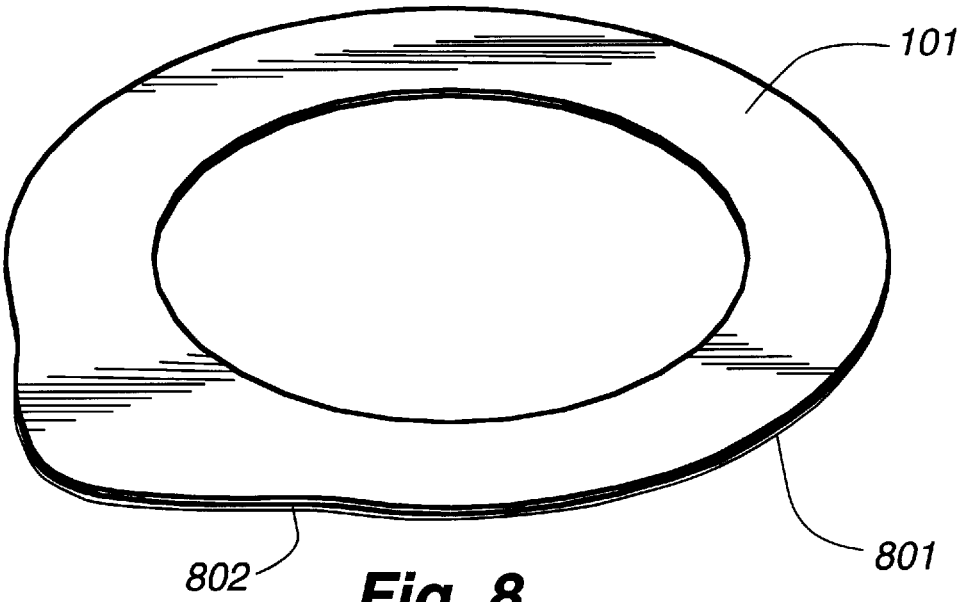
FIG. 8 shows the can rim seal in accordance with the present invention in a form suitable for distribution.
Figure 9:
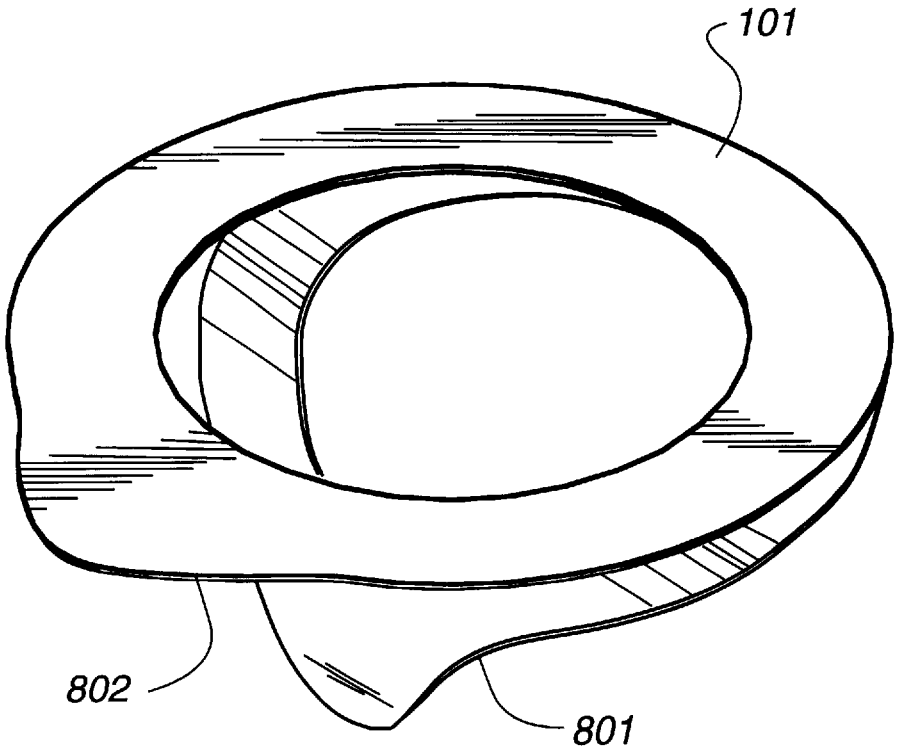
FIG. 9 shows the can rim seal of FIG. 8 being prepared for use.

FIG. 8 and FIG. 9 show a can rim seal in accordance with the present invention in a form suitable for distribution. Can rim seal 101 is advantageously formed by a multi-layer laminate structure comprising a release paper 801, adhesive 802, and rim seal layer 101. The rim seal layer 101 may itself comprise a multi-layer composite or laminate structure. A first layer may provide strength and tear resistance (e.g., tyvek, mylar, and the like) while another layer (e.g., metal, paper) or layers may provide memory, chemical resistance, or another property.

The rim seal 101 in accordance with the present invention can be manufactured by providing the three-layer laminate structure as a continuous tape and die-cutting the specified inner and outer edges. The resulting trimmed structure shown in FIG. 8 can be easily packaged singly or in multiple packages. In a preferred embodiment, the upper surface of seal 101 can be used to display printed advertisement or company logos. These displays can be added at any time during the manufacturing process before or after the three layer laminate is formed and may be provided after cutting to form the structure shown in FIG. 8.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A seal for a can rim, the can rim having an interior edge and an exterior edge, the seal comprising:

a deformable ring-shaped rim seal having in both an installed and an uninstalled configuration, a width defined by an interior edge having a diameter smaller than the can rim and an exterior edge having a diameter larger than the can rim, wherein the deformable rim seal comprises metal foil in the form of a flat layer of foldable material having a thickness and composition selected to enable the rim seal to fold over edges of the can rim so as to bend conformably about the interior and exterior edges of the can rim;

a pressure sensitive releasable adhesive coating on one surface of the deformable rim seal; and an alignment ridge formed between the interior and exterior diameters.

2. A painting system with a removable, resealable lid comprising:

a paint can comprising a sidewall defining an interior and an exterior surface of the can and having an upper portion forming a rim and paint contained within the can, wherein the rim is adapted to form a seal with the removable, resealable lid;

a deformable ring-shaped rim seal having a width defined by an interior diameter smaller than the can rim and an exterior diameter larger than the can rim, wherein the rim seal comprises a flat layer of foldable material having a thickness and composition selected to enable the rim seal to fold over and seal to an interior edge and an exterior edge of the can rim; and a pressure sensitive releasable adhesive coating on one surface of the deformable rim seal, wherein the rim seal is removably attached to cover the can rim and portions of the interior and exterior surfaces while the lid is removed to protect the rim from exposure to the paint contained within the can.

3. The painting system of claim 2 further comprising an alignment groove formed in the deformable rim seal between the interior and exterior diameters.

4. The painting system of claim 2 wherein the thickness of the deformable rim seal is selected to allow the rim seal to bend conformably about the can rim and adhesively seal to the interior and exterior surfaces of the sidewalls.

5. The painting system of claim 2 wherein the deformable rim seal comprises metal foil.

6. The painting system of claim 2 wherein the deformable rim seal comprises paper.

7. The painting system of claim 2 further comprising a chemically resistant surface on the deformable rim seal opposite the surface of the adhesive.

* * * * *